United States Patent [19]

Spiegel

[11] 4,224,889

[45] Sep. 30, 1980

[54] MULTIHULL SAILING CRAFT AND HULL STRUCTURE THEREFOR

[75] Inventor: Michael S. Spiegel, Miami Beach, Fla.

[73] Assignee: Separate Reality, Inc., Miami Beach, Fla.

[21] Appl. No.: 967,451

[22] Filed: Dec. 7, 1978

[51] Int. Cl.[3] ..... B63B 1/20

[52] U.S. Cl. ..... 114/39; 114/61; 114/291

[58] Field of Search ..... 114/61, 56, 39, 291, 114/283

[56] References Cited

U.S. PATENT DOCUMENTS

| | | | |
|---|---|---|---|
| Re. 28,615 | 11/1975 | Keiper | 114/283 |
| 209,414 | 10/1878 | Norcross | 114/61 |
| 529,065 | 11/1894 | Dodge | 114/291 |
| 1,010,376 | 11/1911 | Keissler | 114/56 |
| 1,296,155 | 3/1919 | Bazaine | 114/291 |
| 1,537,973 | 5/1925 | Uppercu | 114/291 |
| 1,898,322 | 2/1933 | Strode | 114/291 |
| 2,781,735 | 2/1957 | Roberts et al. | 114/61 |
| 2,960,957 | 11/1960 | Eddy | 114/56 |
| 3,226,739 | 1/1966 | Noe | 114/56 |
| 3,299,847 | 1/1967 | Bertholf | 114/61 X |
| 3,665,885 | 5/1972 | Javes | 114/61 |
| 3,788,257 | 1/1974 | Miller | 114/39 |
| 3,796,175 | 3/1974 | Ford, Jr. | 114/39 |
| 3,871,316 | 3/1975 | Woodrich | 114/61 |
| 3,998,175 | 12/1976 | Pless | 114/39 |

OTHER PUBLICATIONS

*Multihull Seamanship*, Michael McMullen, National Publishing Company, Ltd., Lymington, Hampshire, England, 1976, pp. 60–61.

*Primary Examiner*—Sherman D. Basinger

*Attorney, Agent, or Firm*—Merchant, Gould, Smith, Edell, Welter & Schmidt

[57] ABSTRACT

A sailing-multihull hull shape is disclosed which is designed to produce hydrodynamic lift in addition to static buoyant displacement lift. The dynamic lift is generated in direct proportion to the horizontal surface area times the square of the velocity of this surface through the water. High-lift, relatively low drag horizontal surface area is provided by a series of horizontal steps on V-shaped amas (sponsons or pontoons) and preferably on the center hull, if any. The width of the steps preferably increases from the keel up, so that the widest is nearest the deck. To reduce drag through wake induced turbulence, it is also preferred to rotate back into the basic V-hull shape so that at the stern there are no visible steps. The enhanced lift produced by the steps can significantly increase the stability and righting moment of the sailing-multihull, and allow a greater load carrying ability with less reduction of speed.

13 Claims, 10 Drawing Figures

100
101
103
2a
2b
3
4
5
6
7
7'
8
9
10
11
12
13
14

MULTIHULL SAILING CRAFT AND HULL STRUCTURE THEREFOR

TECHNICAL FIELD

This invention relates to multihull sailing craft capable of sail-powered speeds through the water greater than displacement hull speed. That is, whether or not the sailing craft of this invention are provided with auxiliary power, through sail power alone they are capable of achieving at least semi-planing speeds, i.e. speeds at which the hulls of the sailing craft are capable of at least partially climbing over their own bow wave. An aspect of this invention relates to hull shapes for multihull sailing craft. Still another aspect of this invention relates to hull shapes or designs for each "ama" or sponson or pontoon. Still another aspect of this invention relates to catamarans, trimarans, sailing proas, outriggers, and other multihull craft which are sail-powered and capable of speeds greater than displacement hull speeds.

BACKGROUND OF PRIOR ART

Perhaps of earliest boat designs were generally limited to so-called displacement hulls, which had certain inherent speed limitations. It was probably sometime later that boat makers discovered the planing hull principle, which permitted much greater speeds at some sacrifice of stability. Multihull designs were created to combine at least some of the stability advantages of displacement hulls with the speed advantages of planing hulls. It is well known that, through sail power alone, a multihull sailing craft can achieve at least a semi-planing condition which overcomes some of the inherent speed limitations of a displacement hull while still retaining some semblance of stability.

An important stabilization factor in all existing multihull designs (e.g. trimarans and catamarans) is the static displacement of water by the leeward hull, creating a righting force on a moment arm of one-half of the total beam, i.e. the beam of the total multihull craft, including both outboard hulls and the center hull, if any. The static displacement force is the Archimedes force of the weight of the displaced water acting perpendicularly to the water surface. As is known in the art, gravitational forces can also be used to counteract the heeling moment produced by the wind on the sails; in smaller boat designs such as day sailing catamarans, the shifting of passenger weight is a simple means for applying such gravitational forces.

Nevertheless, users of multihull sailing craft do encounter stability problems. For example, it is possible for the heeling moment to equal or exceed the righting moment (including the moment of gravitational forces about the leeward ama), in which case capsizing becomes possible. For most conditions, the critical factor acting against capsizing of larger multihull craft is a force F acting generally parallel to the mast, i.e. generally perpendicular to the horizontal plane of the vessel's deck. An important function of the ama (sponson, pontoon, outboard hull, etc.) is to produce this force, which acts upward at the approximate longitudinal and transverse centers of the ama. Thus the force F produces a moment FB where B is one-half the transverse distance between the longitudinal axes of the amas. For convenience of discussion, one can disregard gravitational forces and concentrate upon the FB moment of force, particularly for off-shore cruising yachts, where stability enhancement is a primary concern and gravitational forces come into play only for nonsubmersible amas under extreme wind conditions.

Following these principles, many multihull sailing craft designers have specified extremely lightweight construction of the craft and have employed slim, low buoyancy amas and large crossbeams to produce the desired righting moments. These restrictions have produced vessels that, because of their large beam widths (i.e. the beam for the total vessel including all hulls) are under great stress. Yet, because of concern with the weight of the craft, these vessels are built with minimum structure. Furthermore, the slim, low buoyancy amas may become easily submerged, at which time they add nothing to the righting moment.

Another approach would be to utilize amas with greater buoyancy and wider beams (i.e. the beam of each individual ama would be relatively wide as compared to the aforementioned slim, low buoyancy amas). Such an approach typically leads to much greater drag coefficients for the blunter (greater cross-section) higher displacement amas.

The subject of drag (e.g. hydrodynamic drag) also bears a relationship to problems of stability encountered by designers and users of multihull sailing craft. Theoretically, drag (water resistance and/or air resistance) is proportional to the square of the velocity of the boat through the water. Although, as a practical matter, it is virtually impossible to calculate the total drag on a sailboat through theoretical considerations alone, it appears to be entirely valid to assume an exponential relationship between fluid resistance and the velocity through the fluid, hence exponential decreases in velocity caused by increasing air and water resistance, particularly increasing water resistance. Thus, as can be produced by the quick immersion of a blunt high buoyancy ama, or if some other discontinuous, drastic increment in total drag is felt by the craft, the resulting exponential decrease in velocity through the water can have equally radical destabilizing effects such as pitchpoling (a forward tumbling action which results in a forward capsize).

In recent years, great strides have been made in improving the stability of single hulled powered boats. Among the innovations in this field has been the use of the so-called stepped-V hull design. Theoretically, the principles of designing single hull power boats should have virtually no applicability to the problems of multihull sailing craft. Power boats designed for high speed (planing or semi-planing speeds) typically have sufficient reserve power to restore the planing or semi-planing condition even in the event of a disproportionate increase in drag. Such reserve power is typically not available to sailing craft, even those provided with auxiliary power. (The typical auxiliary power unit is adequate for displacement hull speeds only.) Similarly, designers of power boats do not feel tied to the concept of low buoyancy hulls with high length/beam ratios. Quite the contrary: some very fast single hull power boats have a scow-like hull or some similar board beam design. A power boat design with a length/beam ratio less than 10:1 or even less than 8:1 would not be unusual.

The following list of references is believed to provide a representative sampling of pertinent disclosures drawn from the art of single hull or essentially single hull construction (i.e. including those hulls provided with one or more channels generally parallel to the keel):

| U.S. Pat. No. | Patentee | Issue Date |
|---|---|---|
| 529,065 | Dodge | November 13, 1894 |
| 1,010,376 | Vonkeissler | November 28, 1911 |
| 1,296,155 | Bazaine | March 4, 1919 |
| 3,226,739 | Noe | January 4, 1966 |

The following references are believed to be representative of the pertinent state of the art regarding multihull craft:

| U.S. Pat. No. | Patentee | Issue Date |
|---|---|---|
| 209,414 | Norcross | October 29, 1878 |
| 2,781,735 | Roberts et al | February 19, 1957 |
| 3,665,885 | Javes | May 30, 1972 |
| 3,788,257 | Miller | January 29, 1974 |
| 3,796,175 | Ford, Jr. | March 12, 1974 |
| 3,871,316 | Woodrich | March 18, 1975 |
| Re. 28,615 | Keiper | November 18, 1975 |

The following additional references are believed to be of interest regarding the state of the art of pontoon and hull structure generally.

| U.S. Pat. No. | Patentee | Issue Date |
|---|---|---|
| 1,898,322 | Strode | February 21, 1933 |
| 3,299,847 | Bertholf | January 24, 1967 |

BRIEF SUMMARY OF THE INVENTION

It has now been discovered that a particular shape for an ama (preferably also employed for the center hull in the case of a trimaran) is capable of providing a stabilizing function derived from hydrodynamic lift. This dynamic or hydrodynamic lift is provided in addition to the static buoyant displacement; accordingly, ama with high length/beam (l/b) ratios can be used with great advantage in the context of the present invention. Furthermore, the hydrodynamic lift generally increases with increasing speed through the water and thus becomes available to the craft precisely at the times when it is most needed. This stabilizing function is achieved by means of a series of horizontal steps on a V-shaped hull. (A symmetrical hull of this type is sometimes referred to as a "stepped-V" hull, although typical prior art stepped-V designs are not preferred in the context of this invention.) The dynamic lift is believed to be generated in direct proportion to suitably positioned horizontal surface area (i.e. horizontal surface area at a suitable angle of attack) times the square of the velocity of the surface through the water. Considerations of angle attack aside, the wider the horizontal steps, the greater the dynamic lift.

In short, a multihull sailing craft of this invention (which is capable of speeds greater than displacement hull speeds) is provided with amas having a generally symmetrical stepped-V transverse cross-section or half cross-section. Each half cross-section of each hull provides a plurality of hull steps. The preferred symmetrical stepped-V hulls provide a plurality of inboard-outboard pairs of generally longitudinal hull steps. That is, the hull steps extend generally horizontally outward from the longitudinal center line of the ama and along a major portion of the length of the ama. Excellent dynamic lift can be produced with ama hulls having a length/beam ratio greater than 10:1, e.g. from about 12:1 to about 15:1.

Depending upon the angle of attack of the horizontal steps, these steps can contribute significantly to the total drag forces acting on the craft. This has been found to be particularly true for an angle of attack of the flat surfaces in excess of 5° or even in excess of 3°. Preferably, the angle of attack of the widest of the steps is less than about 5° and the angle of attack of the flat surfaces of the narrowest of the steps is less than about 3°.) In a preferred embodiment of the invention, drag is reduced by gradually increasing the width of the steps from the keel up, so that the widest hull step is nearest the deck. To reduce drag through wake-induced turbulence, it is also preferred to have the width of the steps decrease as the steps approach stern. An optimum technique for achieving this effect is to rotate the steps back into the basic V-shape, so that at the stern there are no visible steps.

Thus, in accordance with this invention, it can be possible to achieve improvements in stability while keeping any increase in drag within sufficient bounds such that drastic loss of velocity through the water is not observed. Furthermore, the risk of totally submerging the leeward ama is reduced. Greater structural integrity can become possible, since the dynamic lift stabilizing forces can contribute to greater load-bearing capacities under adverse weather conditions. A craft constructed according to this invention can also be capable of good performance in light airs.

Figures 1, 2, 2A, 2B, 3:
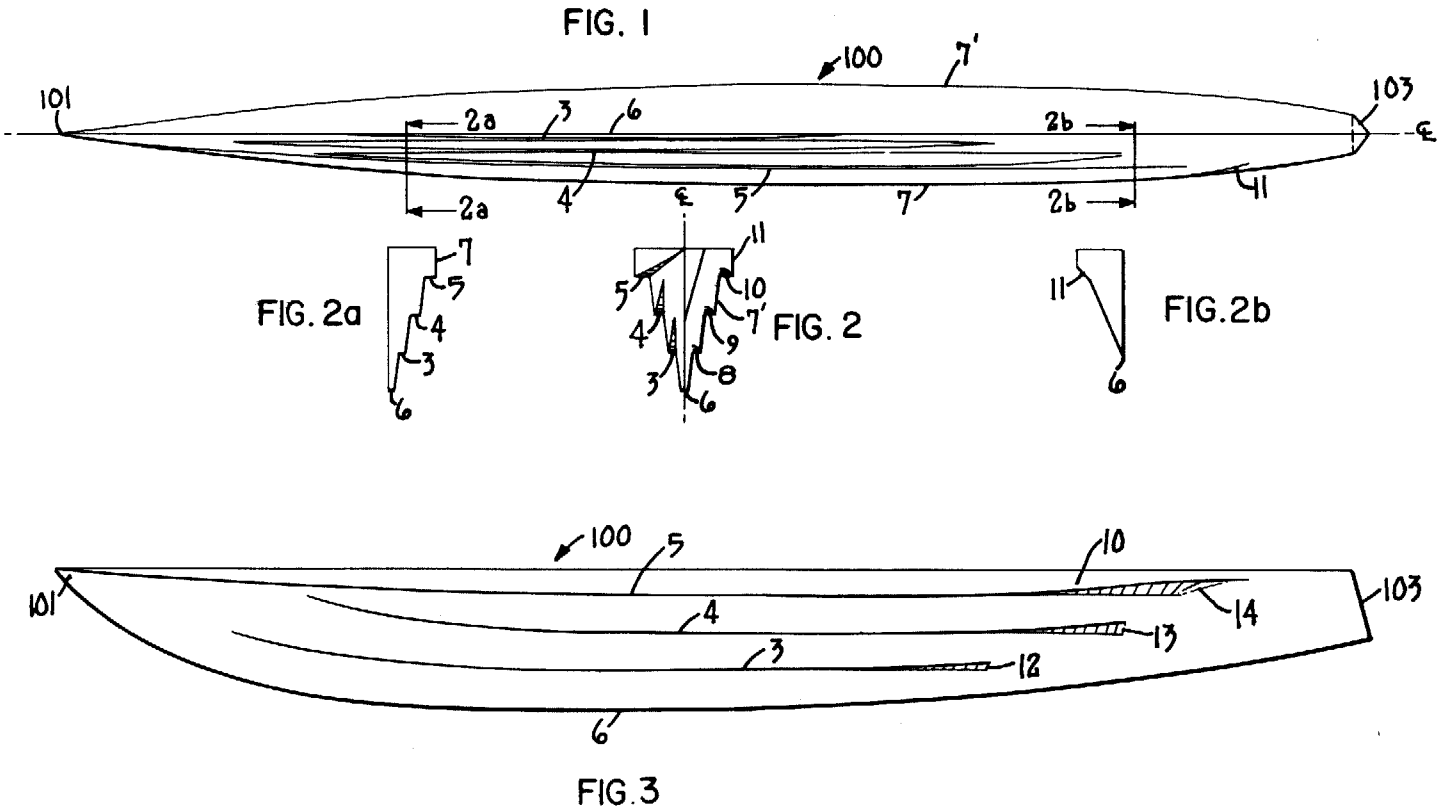
FIG. 1 is a bottom plan view of an ama (pontoon, sponson, etc.). For convenience of illustration, the hull steps are shown on only one side of the ama hull; in the preferred, symmetrical stepped-V embodiment, the side shown as unstepped would be a mirror image of the stepped side.
FIG. 2 is a split end view of the bow and stern of the ama of FIG. 1, showing a symmetrical stepped-V transverse hull shape.

FIG. *2a* is a cross-sectional view taken along line *2a—2a* of FIG. 1, with only half of the cross-section being shown, the other half, in the preferred symmetrical embodiment, being a mirror image of that which has been shown.

FIG. *2b* is a cross-sectional view taken along line *2b—2b* of FIG. 1, only half the cross-section being shown, the other half, in the preferred symmetrical embodiment, being a mirror image of that which has been shown.

FIG. 3 is a side elevational view of the embodiment of the ama shown in FIG. 1.

Figure 4:
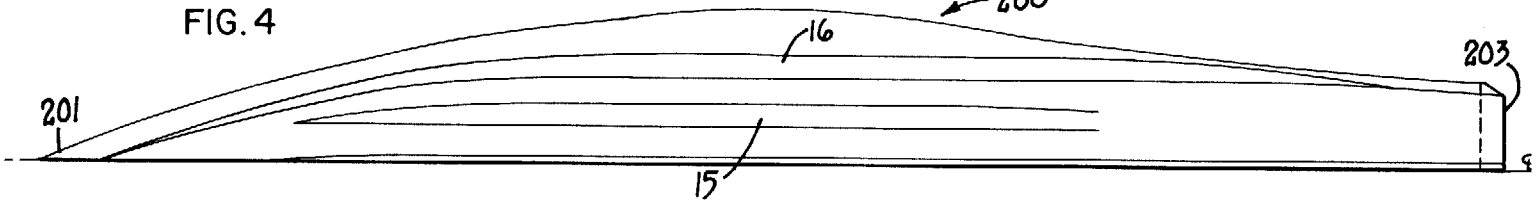

FIG. 4 is a bottom plan view of the center or main hull of a trimaran configuration, which configuration can include the embodiment of FIG. 1 as the two amas; only half of the bottom plan view of the center hull is shown (from the longitudinal center line outward), the other, non-illustrated half being a mirror image of the half which has been shown.

Figure 5:
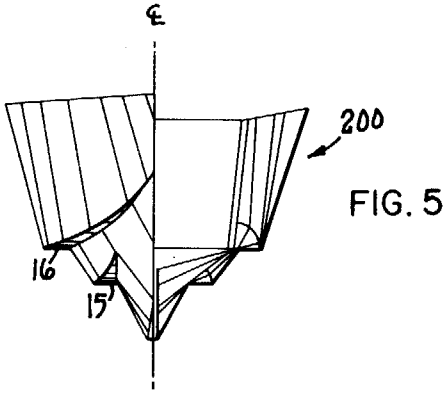

FIG. 5 is a split end view of the main hull shown in FIG. 4, the internal lines indicating various hull sections, and the stern view illustrating the preferred embodiment in which the hull steps are rotated back into the basic V-shape of the hull.

Figure 6:
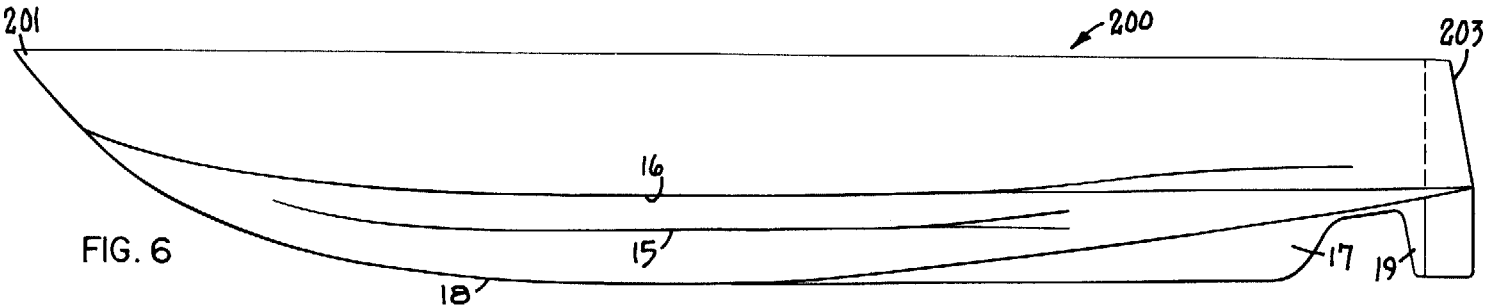

FIG. 6 is a side elevational view of the hull of FIGS. 4 and 5.

Figures 7, 8:
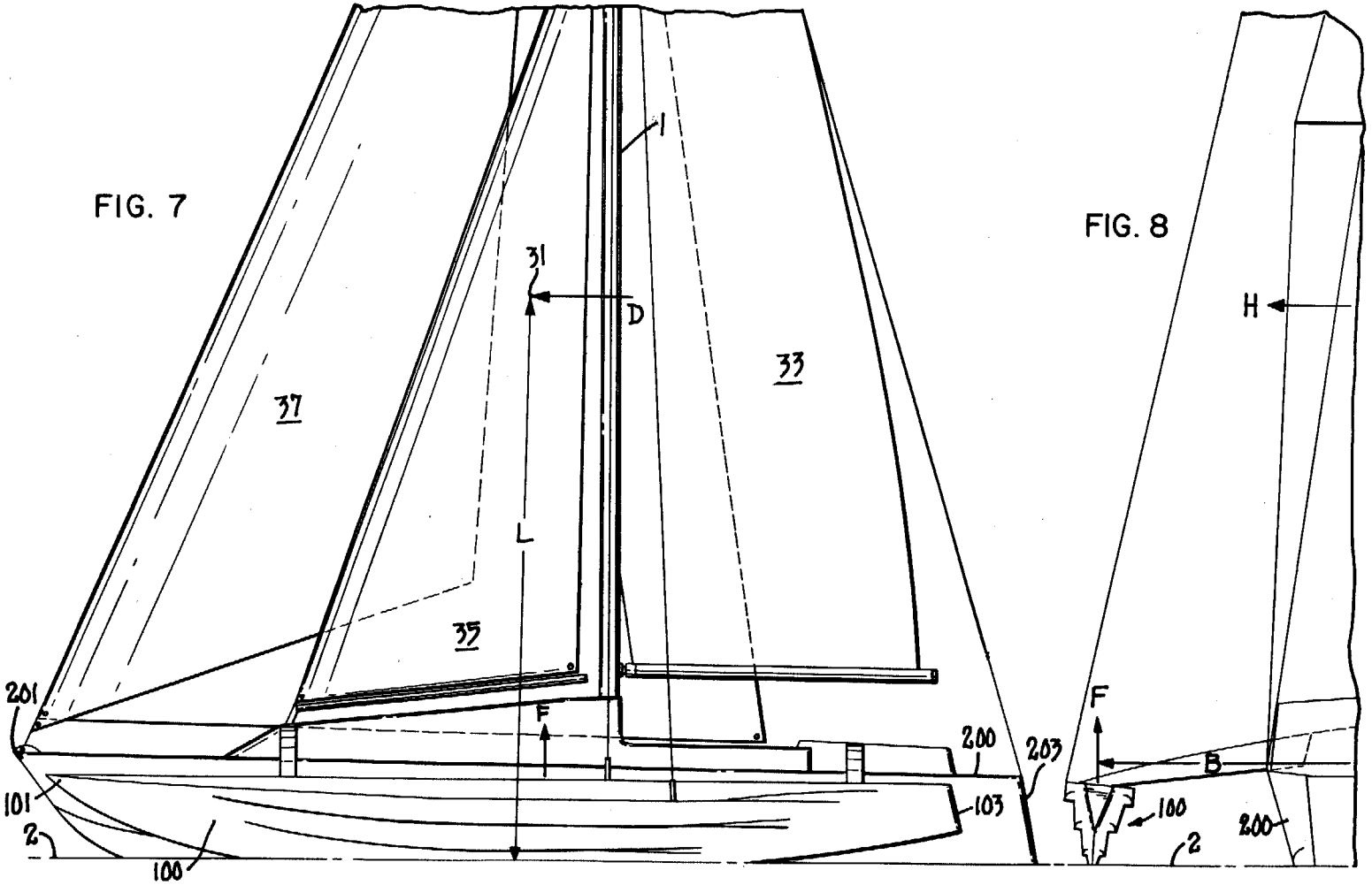

FIG. 7 is a partial side elevational view on a reduced scale (as compared to FIGS. 1 through 6) of the trimaran configuration comprising amas of FIGS. 1 through 3 and a center hull of FIGS. 4 through 6, and showing the lower part of the rigging and other structure above deck level and further showing the relationship of the complete trimaran craft to the water line when the craft is afloat.

FIG. 8 is a partial stern end view of the trimaran craft of FIG. 7.

DETAILED DESCRIPTION

The step stabilization/dynamic lift aspect of this invention may be applied to any sailing multihull, the range of application being from 10' to 100' with emphasis typically on off-shore cruising yachts where stability enhancement is of primary concern. It presently appears that the improvements in design of hull shape in multihulls of this invention will provide at least two significant advantages in the safety of sailing, particularly in rough weather, but with no significant sacrifice of performance in light airs. The employment of the improved stepped-V hull constructions of this invention will, it is believed, counteract the trend toward extreme lightweight construction (wherein, in the quest for less and less weight, some structural integrity may be sacrificed) and the tendency of previously preferred slim, low buoyancy amas to submerge too easily under the influence of strong heeling moments. The dynamic lift produced by the hull steps on amas of this invention can increase the righting moment (i.e. the stability) by 25% at speeds above 10 knots and by as much as 40–50% at speeds of 18–20 knots.

Since the center or main hull of the trimaran embodiment is designed with hydrodynamic, lift-producing hull steps, it will generate lift on the order of 15–25% of the total displacement at semi-planing speeds. Thus the main hull may have a weight increase of 15–25% with only small dimunition in speed, since the added weight will not effectively increase wetted surface at semi-planing speed. This ability to increase loading without sacrificing performance allows the designer to add to the basic structure of the vessel and thus produce a seagoing, multihull sailing craft of total structural integrity.

As noted previously, an important function of the ama (perhaps the primary function) is to produce a force perpendicular to the horizontal plane of the vessel's deck. Referring to the Drawing (wherein like numerals denote like parts throughout the several views), ama 100 produces a force parallel to mast 1 (FIG. 7) This force F (FIGS. 7 and 8) acts upward at the approximate longitudinal and transverse centers of amas 100. Thus the force F produces a moment FB wherein B is one-half the transverse distance between the longitudinal axes of amas 100. (The ama 100 on the opposite side of main hull 200 of FIG. 7 is obscured by main hull 200.)

The wind on the sails 33, 35, and 37 (FIG. 7) exerts a force H (FIG. 7), which can be considered to be acting at the center of effort (C.E.) 31, a distance L above water line 2. (This consideration is somewhat of a simplification, as L will vary slightly, depending on dynamic conditions.) The product of force H and distance L is the heeling moment HL.

Theoretically, it is the balance of moments FB and HL that produces the primary stability of a multihull sailing craft. Thus as long as FB equals HL the vessel will be in transverse stability for all but the most extreme conditions. Calculation shows that, if FB equals HL capsize may still occur if HL exceeds the moment of gravitational forces about the leeward ama. This is seen most readily in small sailing catamarans, where shifting passenger weight to windward prevents capsize if the leeward hull is not driven below the surface.

Accordingly, as noted previously, the critical factor providing stability against capsizing in larger multihull sailing craft is the righting moment FB. The distance B can be increased, thereby increasing FB, but the increased beam of the total craft can result in increased structural stress. The force F can be increased by increasing the displacement of the ama (thereby increasing the static or Archimedes force), but the price of such an increase in F may be substantially increased drag at higher speeds, particularly if the relatively slim ama designs now preferred by most designers have to be abandoned. As noted previously, greater drag from blunter amas increases the possibility of pitchpoling (submersion of the leeward ama bow and forward tumbling to a forward capsize).

Using the concept of hydrodynamic lift, the force F can be made to increase with increases in the heeling force H. Force F can be considered to be the sum of two forces, i.e. the hydrodynamic lift and the Archimedes force or static buoyant displacement lift. In this invention, the focus is shifted more toward the hydrodynamic lift aspect of F.

It is known that the dynamic or hydrodynamic lift is generated in direct proportion to the horizontal surface area times the square of the velocity through the water:

$$L \sim A_H V^2$$

wherein L represents dynamic lift, $A_H$ represents the horizontal surface area through the water, and V represents the velocity of the surface area through the water.

Any given hull structure has a coefficient of lift C which can be considered to be a constant within a given velocity range. Accordingly, the hydrodynamic lift of such a hull can be expressed as $CAV^2$, wherein A is the horizontal wetted surface of the hull.

Returning to the basic proposition that F is the sum of dynamic and static (Archimedes) lift forces:

$$F = d + CAV^2 \quad (1)$$

wherein d = the Archimedes force = $\rho\omega G$, $\rho\omega$ being the density, and G being the volume, of the displaced water.

Excluding consideration of gravitation forces for the reasons explained previously, horizontal stability can be considered to be established when the following balance of moments is satisfied.

$$FB \geqq HL \quad (2)$$

or $$B(d + CAV^2) \geqq HL \quad (3)$$

The force H is only one component of the total force on the sails. Thus H (FIG. 7) is coupled with driving force D (FIG. 7) on the sails, and as D increases the velocity of the hulls through the water increases.

Now, for fixed wind angles H is proportional to D, or $H = \delta D$, where D is the driving component of the total force in the sails and $\delta$ is a constant. Thus, from equation (3) we get:

$$Bd+BCAV^2 \geqq \delta LD. \quad (4)$$

Suppose now that the multihull sailing craft has heeled up to the point at which the leeward ama is submerged up to deck level. At this point the displacement force d is at a maximum, i.e. $d=d_{tot}$; the wetted surface A is at a maximum, i.e. $A=A_{tot}$. (For an ama of this invention with horizontally opposed pairs of hull steps, $A_3$, $A_4$, $A_5$, etc., $A_{tot}=2A_3+2A_4+2A_5$, etc.)

Accordingly, for this maximum ama submersion condition, $$Bd_{tot}+BCA_{tot}V^2 \geqq \delta LD \quad (5)$$

and the terms and factors $Bd_{tot}$, $BCA_{tot}$, and $\delta L$ are all constants dictated by craft design or similar considerations. If we represent the constant $Bd_{tot}$ by $\alpha$, the constant $BCA_{tot}$ by $\beta$, and the constant $\delta L$ by $\gamma$, expression (5) becomes:

$$\alpha+\beta V^2 \geqq \gamma D$$

or $$V^2 \geqq \gamma/\beta D-\alpha/\beta \quad (6)$$

Since for all dynamic conditions D=R, where R is the total drag or resistance, $$V^2 \geqq \gamma/\beta R-\alpha/\beta, \quad (7)$$

the expressions $\gamma/\beta$ and $\alpha/\beta$ both being constants.

Simply stated, for non-gravitational moments to be balanced, the square of the boat velocity must be greater than or equal to the total hull drag times a constant minus a constant.

What can be inferred from these equations or inequality expressions is that, if a hull design which produces dynamic lift does not produce induced drag so large as to prevent velocities required to balance the heeling forces, a dynamic balance can be achieved.

I have now discovered that a solution to equation (7) does exist. The sailing craft shown in the Drawing (e.g. FIGS. 7 and 8) provides an illustrative embodiment of such a solution. In this particular solution to the equation as embodied in a functioning multihull sailing craft, the amas have a stepped-V configuration, a high aspect ratio, a high length-to-beam ratio, and are high dynamic-lift, low drag structures.

DETAILED DESCRIPTION OF THE PREFERRED EMBODIMENT

FIGS. 1 through 3 illustrate a typical high dynamic-lift, low drag ama 100 of this invention. The basic transverse shape of the hull of ama 100 is that of a V with horizontal discontinuities, i.e. hull steps. The cross section or transverse shape is not, of course, identical from bow to stern, and the steps tend to have a greater frontal aspect near the bow 101 and are totally absent from the cross-section at the stern 103. Nevertheless, for a major portion of the length of the ama 100, steps 3, 4, 5, 8, 9, and 10 are at least generally horizontal and have a tendency to produce dynamic lift. The flat portion 6 at the vertex of the V-shaped hull of ama 100 (FIGS. 2, 2A, and 2B) acts as a keel and also as a lift-producing step. Working up symmetrically from keel 6, the symmetrical stepped-V design provides hull steps in horizontally opposed pairs 3 and 8, 4 and 9, and 5 and 10. The topmost pair of hull steps 5 and 10 provide lift all the way to bow 101 and at a very modest angle of attack even in the portion nearest bow 101. As noted previously, it is preferred to employ a symmetrically stepped-V transverse cross-section for the hull of ama 100. If only one half of the V is stepped (a less preferred embodiment better suited to light-weight day-sailing catamarans and the like), it is preferable to step the inboard half of the V, so that the ama hull will point to windward more easily.

In the preferred, symmetrical stepped-V embodiment, there are inboard/outboard pairs of steps. The pairs of horizontal hull steps, 3 and 8, 4 and 9, and 5 and 10 can be brought all the way back to the stern, so that the stern itself has the stepped-V configuration; provided that the center hull, in the case of a trimaran, has a design similar to that of main hull 200. The principal disadvantage of such an ama hull design is that the stepped-V stern can produce a modest wake or other drag-creating or -inducing effects, which are particularly noticeable in catamarans. Accordingly, it is preferred to rotate the steps back into the basic V shape as the steps approach the stern, the result being, in effect, a gradual decrease in the horizontal surface area and lift producing ability of the steps (i.e. a smoothing out of the steps) as they approach the stern. As will be apparent from FIGS. 1 through 3, at least a plurality of steps on at least one side of ama 100 is generally in an orientation with respect to the water surface such that hydrodynamic lift can be produced at semi-planing speeds.

A center or main hull 200 is shown in FIGS. 4 through 6. This main hull 200 can be arranged with an ama 100 on the port and starboard sides to provide a trimaran configuration. Alternatively, two amas 100 can be arranged in a catamaran configuration with a suitable cross member capable of supporting a mast and a generally horizontal deck surface extending between the amas. It has been found that the principles of ama design illustrated in the embodiment of FIGS. 1 through 3 can be successfully and advantageously applied to center or main hull design for a trimaran. Accordingly, main hull 200 is provided with horizontal discontinuities or hull steps 18, 15, and 16. Hull step 16 is somewhat analogous to hull step 5 of ama 100 in that it provides lift all the way to bow 201 of main hull 200. Main hull 200 has a much lower length/beam ratio than ama 100; however, in other respects its design bears considerable resemblance to ama 100. There is a stepped-V hull configuration which provides horizontally opposed pairs of hull steps each having a modest angle of attack, so that they are highly efficient in terms of lift/drag ratio. As will be apparent from FIG. 5 and FIG. 6, the hull steps are rotated back into the basic V shape to provide decreasing horizontal surface area as the steps approach the stern 203.

FIGS. 7 and 8 illustrate the preferred trimaran configuration in which center hull 200 is combined with an ama 100 on each side arranged generally parallel to the center line $C_L$ of center hull 200. However, a plane passing through the center line $C_L$ of each ama 100 would not necessarily be parallel to a plane passing through $C_L$ of center hull 200. As shown in FIG. 8, the plane through $C_L$ of each ama 100 can be inclined slightly from the vertical toward main hull 200.

The preferred configuration shown in FIGS. 7 and 8 can be of virtually any desired size depending upon the intended use of the craft. A particularly effective use of the craft shown in FIGS. 7 and 8 is in seagoing yachts of modest size, e.g. 5 to 20 meters in length. The craft of FIGS. 7 and 8 is, for example, ideal for a trimaran having a length of 32 feet (9.8 meters) and a displacement of approximately 4,000 lbs. (1,800 Kg). An ama 100 of such a craft has a displacement of 4,050 lbs. (1,837 Kg) when submerged to deck level, and a length of 28'4" on deck. Main hull 200 is intended for a cruising trimaran with safety and load carrying ability as primary design criteria. The total craft has an overall waterline length/beam ratio of 1.6:1. Main hull 200 has a waterline length-/beam ratio of 6:1 and a basic V shape that flattens and slopes up to the waterline at the stern. The two hull steps 15 and 16 are of equal maximum width. The lower step 15 is longitudinal and the upper step 16 goes all the way to bow 201 and thus can be considered to wrap around the bow. The keelson 17 extends aft of the point of maximum depth of the hull 18 to provide lateral stability and to protect the rudder 19 during groundings or collisions.

A number of design features of the craft shown in FIGS. 7 and 8 are believed to be of great importance with respect to the overall performance of the craft. Of these important features, the following aspects of the design of amas 100 are particularly preferred:

i. The longitudinal shape of ama 100 is that of a high aspect ratio canoe. The length/beam ratio is preferably within the range of 12:1 to 14:1. (For the ama specifically shown in FIGS. 1 through 3 it is 13:1.)

ii. The hull step pairs 3 and 8, 4 and 9, and 5 and 10 are designed to provide maximum lift-producing effectiveness with a minimum of drag. The technique by which this objective is sought involves several design features. First, the lower steps such as hull steps 3 and 4 present less frontal area than does, for example, step 5. (The keel 6 can also be considered to be a step in this context.) Thus, these lower steps provide a greater lift-to-drag ratio and are virtually always submerged. Hull step 5, which provides lift all the way to the bow and thus helps to prevent pitchpoling or tumbling may induce more drag but is less likely to be submered. Stated another way, it is preferred that the topmost pair of hull steps of each ama has the maximum frontal or forward-facing area, and the lowest pair of hull steps of each hull longitudinally extends generally parallel to the longitudinal center line of the hull. Second, the lift-producing area of the step pairs gradually increases as the step pairs approach the deck level. Thu, if $W_3$ represents the width of hull step 3, $W_4$ represents the width of hull step 4, etc., $$W_5 > W_4 > W_3$$

The increase in step widths are preferably made very gradual by satisfying the following expression:

$$\frac{W_5 - W_4}{W_5} < \frac{W_4 - W_3}{W_4}$$

That is, the fractional increase in width for step 5 is less than that of step 4. For a large number of steps, where a typical step width is $W_i$:

$$\frac{W_{i+1} - W_i}{W_{i+1}} < \frac{W_i - W_{i-1}}{W_i} < \frac{W_{i-1} - W_{i-2}}{W_{i-1}}$$

One simple way to satisfy this condition is to set a constant increase in step width, $\Delta W$. Then $$\frac{\Delta W}{W_{i+1}} < \frac{\Delta W}{W_i} < \frac{\Delta W}{W_{i-1}}$$

Random increases in step width are not preferred. It is normally preferred that $\Delta W_i$ be constant ($\Delta W$) or within the range of $\Delta W + n\ \Delta W$, where n can range from zero to about 0.3. Excessively large increases in step width can result in an ama with an excessively broad beam and an unacceptable length/beam ratio. In the embodiment of FIGS. 1-3, the constant $\Delta W$ is one-half of the keel width; accordingly, $W_3 = 2W_6$; $W_4 = W_3 + W_6 = 3W_6$; and $W_5 = W_4 + W_6 = 4W_6$. Thus, for example $\Delta W/W_4 \times 100$ is $W_6/3W_6 \times 100$ (step 4 is 33% wider than step 3) and $\Delta W/W_5 = W_6/4W_6$ (step 5 is only 25% wider than step 4).

Third, the ends 12, 13, and 14 of hull steps 3, 4, and 5 are staggered so as to release water pressure from lower to upper steps in a smooth pattern.

iii. Further improvements in reducing drag can be obtained by minimizing wake turbulence. Thus, it is normally preferred that after body of ama 100 be smooth and narrow. As explained previously, this can be achieved by rotation of steps 3, 4, and 5 back into the hull. Rotational segments 8, 9, and 10 (FIGS. 2 and 3) show the rotation of each hull step until the step surface matches the angle of the hull and blends into the overall surface. In the rear portion of segment 10 the vertical side of the deck 11 rotates inward to match the hull surface and give a clean run-out. The two cross-sections, FIGS. 2A and 2B show the difference between the horizontal-stepped and the rotated sections of the ama.

Thus, it has been found that the rate of rotation of the steps versus longitudinal run (as well as the location of the ends of the steps) will affect the induced drag. The preferred rates of rotation into the stern for the steps in ama 100 and center hull 200 are discussed subsequently.

The high-aspect ratio canoe shape of ama 100 can be described in terms of the slope of the sides 7 of ama 100. At the longitudinal midpoint of ama 100, this slope is only 5° to the vertical, but the slope increases as the sides 7 approach the bow and the stern. At the point where the steps cease (near the stern) the slope is 23°. The slope is 11° near the bow. The ratio of the total horizontal lifting cross-section to length is 1 to 17; that is, $2(W_6 + W_5 + W_4 + W_3)$/deck length = 1/17. Thus, this high aspect ratio canoe shape is provided with a considerable amount of horizontal lifting surface, due to the flat keel 6 and the pairs of steps 3 and 8, 4 and 9, and 5 and 10.

PREFERRED RATES OF ROTATION OF HULL STEPS INTO THE STERN

For ama 100, the total slope of the step from beginning of rotation to the end of the step is dependent on the rate of rotation in degrees/inch of the longitudinal run. If the slopes are too great there will be flow separation and large induced drag. The literature suggests a maximum slope of 14° to avoid flow separation. Table I below indicates the slopes and rotation rates of this design.

Table I

| Step | Slope (Degrees) | Rotation Rates (Degrees/inch) |
|---|---|---|
| 8 | 2.5 | 1.53 |
| 9 | 3.15 | 1.33 |
| 10 | 4.1 | 1.29 |

Slopes and rates within ±30% of these values will be effective. Notice the increasing slope and slower rotation rate from lower to upper steps, i.e. from step 8 through step 10.

For main hull 200, both steps 15 and 16 rotate back into the hull in the manner described above for the ama with slopes and rotation rates shown in Table II.

Table II

| Step | Slope (Degrees) | Rotation Rates (Degrees/inch) |
|---|---|---|
| 15 | 4.2 | 0.66 |
| 16 | 3.5 | 0.87 |

As noted previously, the boat design shown in the Drawing is illustrative of a yacht-like trimaran. Day-sailing multihull craft can advantageously embody the principles of this invention also. Another type of multihull sailing craft in use today is the sailing proa, which is, in effect, a double-ended craft with bows only and no sterns. A sailing proa constructed according to the principles of this invention is symmetrical about the vertical center axis of each hull and has non-rotating steps. In addition, a sailing proa trimaran center hull lacks a keelson.

I claim:

1. In a multihull sailing craft capable of sail-powdered speed through the water greater than displacement hull speed, a plurality of sponsons or amas, each said sponson or ama comprising a sponson or ama hull having:

(a) a generally stepped-V lateral half-cross section, which provides a plurality of generally longitudinal lift-producing hull steps extending generally horizontally outward from the longitudinal center line of said sponson or ama hull and along a major portion of the length of said hull, said hull steps being configured, in their generally horizontal surface area in relation to the hull length, and in their angle of attack, to produce a hydrodynamic righting moment at semi-planing speeds of said sailing craft through the water, with a lift/drag ratio favoring semi-planing speeds and stability at said speeds, said hydrodynamic righting moment being generated generally in direct proportion to the generally horizontal wetted surface area of said hull steps times the square of the semi-planing speed through the water; said hull steps being integral with said hull and shaped to be generally decreasing in lift-producing and drag-producing width as they approach the stern of said hull, until said width is essentially zero, the generally horizontal planes of said hull steps describing a rotational movement toward the planes passing through the legs of the V-shaped lateral cross-section of said hull as said hull steps approach the stern of said hull until said generally horizontal planes are not visible at said stern; and (b) a length-to-beam ratio greater than 10:1, said ratio being selected to minimize hydrodynamic drag at said semi-planing speeds consistent with adequate hull buoyancy for stability at said speeds.

2. Sailing craft according to claim 1 wherein said hull steps increase in average width, the narrowest hull step being closest to the keel of each said ama, the widest hull step being closest to the deck of each said ama.

3. Sailing craft according to claim 2 wherein the angle of attack of the widest of said steps is less than about 5° and the angle of attack of the flat surfaces of the narrowest of said steps is less than about 3°.

4. Sailing craft according to claim 1, wherein said stepped-V lateral half-cross section is the inboard half cross-section.

5. Sailing craft according to claim 4 wherein said ama hull has a generally stepped-V, generally symmetrical lateral cross-section which provides a plurality of inboard and outboard pairs of said hull steps.

6. Sailing craft according to claim 5 wherein the topmost pair of hull steps of each ama has the maximum frontal or forward-facing area, and the lowest pair of hull steps of each said hull longitudinally extends generally parallel to the longitudinal center line of said hull.

7. Sailing craft according to claim 1 wherein, for each ama, $W_1$ is the average width of a first step, closest to the keel of said ama, $W_2$ is the average width of a second step immediately above said first step, and $W_3$ is the average width of a third step immediately above said second step, and wherein:

$$W_3 > W_2 > W_1$$

and wherein:

$$\frac{W_2 - W_1}{W_2} > \frac{W_3 - W_2}{W_3}$$

8. Sailing craft according to claim 1 wherein said craft is a trimaran.

9. Sailing craft according to claim 8 wherein the center hull of said trimaran is provided with a generally symmetrical, stepped lateral cross-section, which provides pairs of generally longitudinal hull steps extending generally horizontally outward from the longitudinal center line of said hull.

10. In a multihull sailing craft, a hull having a generally symmetrical stepped-V lateral cross-section providing a plurality of inboard/outboard pairs of longitudinal lift-producing hull steps extending generally horizontally outward from the longitudinal center line of said hull and along a major portion of the length of said hull, said hull steps being integral with said hull and shaped to be generally decreasing in lift-producing and drag-producing width as they approach the stern of said hull, until said width is essentially zero, the generally horizontal planes of said hull steps describing a rotational movement toward the planes passing through the legs of the V-shaped lateral cross-section of said hull as said hull steps approach the stern of said hull until said generally horizontal planes are not visible at said stern.

11. Sailing craft according to claim 10, wherein $W_1$ is the width of either of said hull steps in the bottommost pair of hull steps, $W_2$ is the width of either of said hull steps in the first higher pair of hull steps above said bottommost pair, and $W_3$ is the width of either of said steps in the second, still higher pair of hull steps above said bottommost pair and said first higher pair, wherein:

$W_3 > W_2 > W_1$ and wherein:

$$\frac{W_2 - W_1}{W_2} > \frac{W_3 - W_2}{W_3};$$

and wherein the rate of said rotational movement of said generally horizontal planes is most rapid for said bottommost pair of hull steps and least rapid for the topmost pair of hull steps.

12. Sailing craft according to claim 10, wherein said craft is a trimaran and said hull is the center hull.

13. Sailing craft according to claim 10, wherein said hull is an ama or sponson hull and has a length/beam ratio greater than about 10:1.

* * * * *